US007022010B1

(12) United States Patent
Cardon

(10) Patent No.: US 7,022,010 B1
(45) Date of Patent: Apr. 4, 2006

(54) AIR CONDITIONER WITH A CIRCULAR AIR DIFFUSER SYSTEM

(76) Inventor: Keith Cardon, 1142 Windsor Way, Lutz, FL (US) 33559

( * ) Notice: Subject to any disclaimer, the term of this patent is extended or adjusted under 35 U.S.C. 154(b) by 0 days.

(21) Appl. No.: 10/930,126

(22) Filed: Aug. 31, 2004

(51) Int. Cl.
*F24F 13/06* (2006.01)

(52) U.S. Cl. ..... 454/292; 454/296; 454/330

(58) Field of Classification Search ..... 454/292, 454/296, 299, 301, 308, 309, 310, 330, 331, 454/332
See application file for complete search history.

(56) References Cited

U.S. PATENT DOCUMENTS 935,187 A * 9/1909 Burgess ..... 454/331
3,815,638 A * 6/1974 Martin ..... 138/103
3,866,950 A * 2/1975 Skoch et al. ..... 285/4
4,175,936 A * 11/1979 Lough et al. ..... 55/385.2
4,182,227 A * 1/1980 Roy ..... 454/302
5,109,756 A * 5/1992 Barboza et al. ..... 454/284
5,281,187 A * 1/1994 Whitney, Jr. ..... 454/296
5,338,255 A * 8/1994 Akehurst ..... 454/292

* cited by examiner

*Primary Examiner*—Harold Joyce
(74) *Attorney, Agent, or Firm*—Edward P. Dutkiewics

(57) ABSTRACT

A ceiling has an upper surface, a lower surface and a circular aperture. A boot has a cylindrical lower section and a large circular cross sectional configuration and with a cylindrical upper section and a small circular cross sectional configuration. The diameter of the circular aperture is slightly greater than the diameter of the lower section of the boot. The boot also includes a circular flange extending radially outwardly from the lower edge of the boot with threaded apertures around the flange. A grill has an exterior diameter equal to the exterior diameter of the flange. Threaded apertures are aligned with the apertures of the flange with bolts to removably couple the grill to the boot. The grill has a plurality of slots for the flow of air there through.

1 Claim, 4 Drawing Sheets

FIG 1
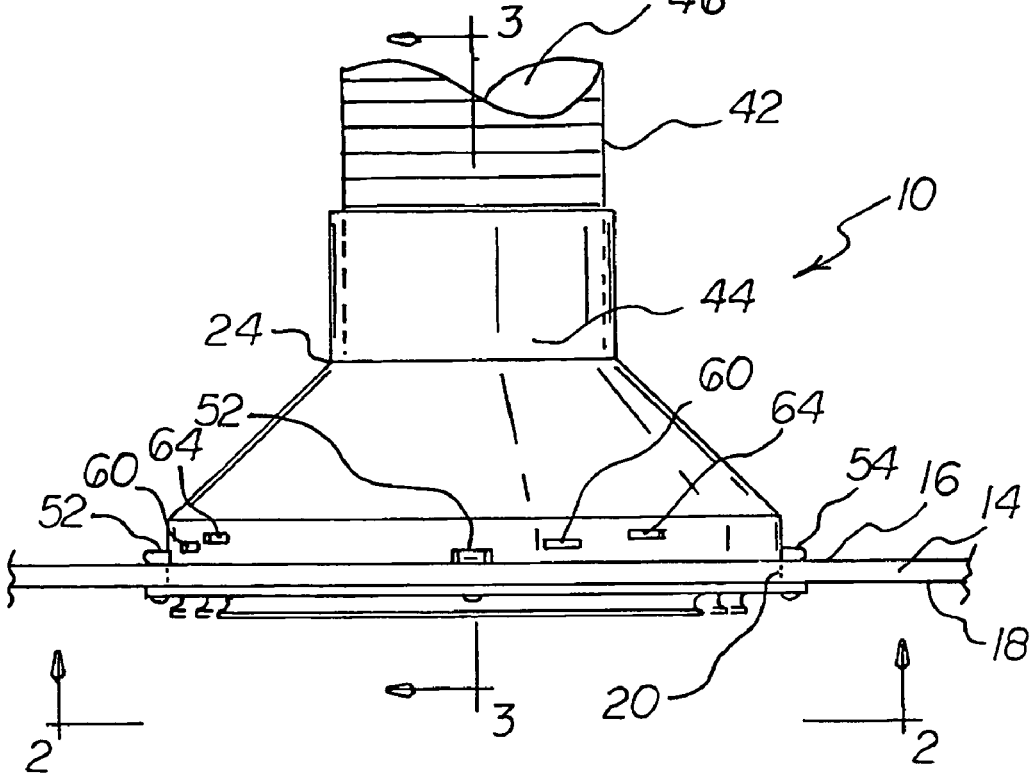
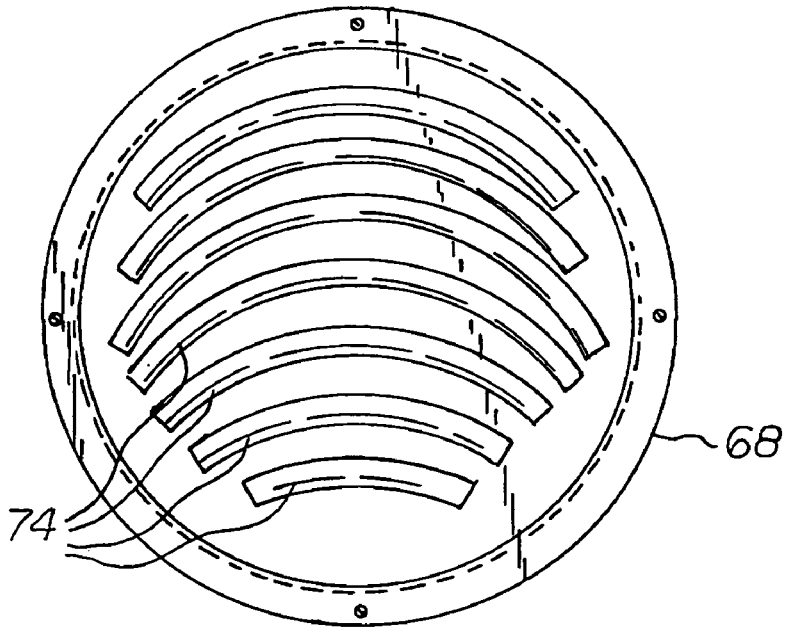
FIG 2

FIG 3
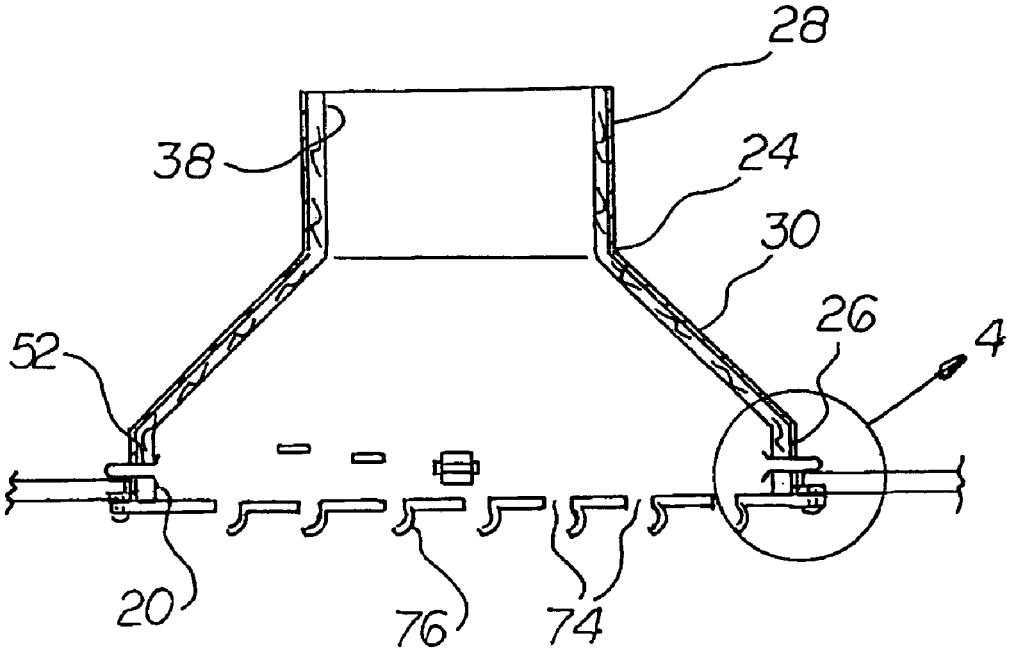
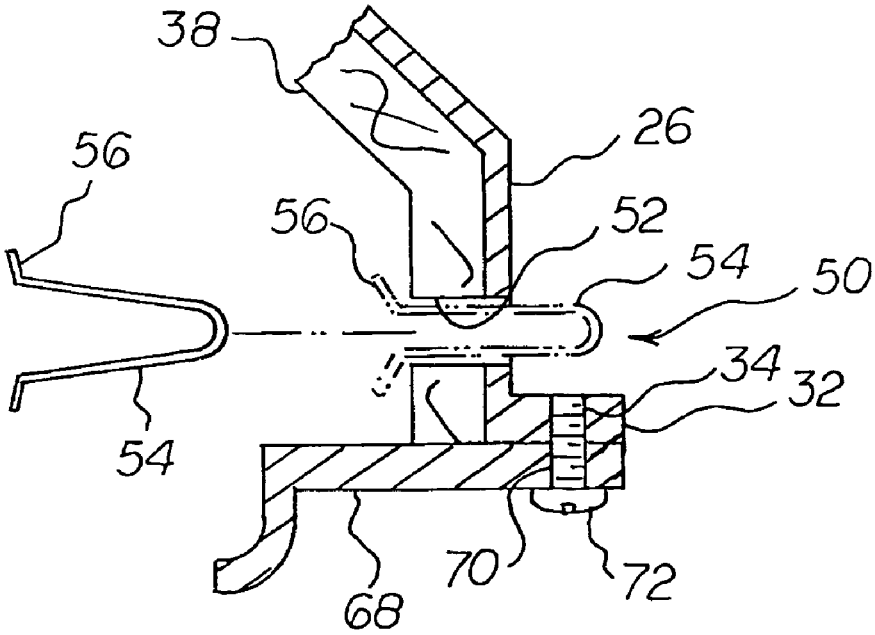
FIG 4

FIG 5
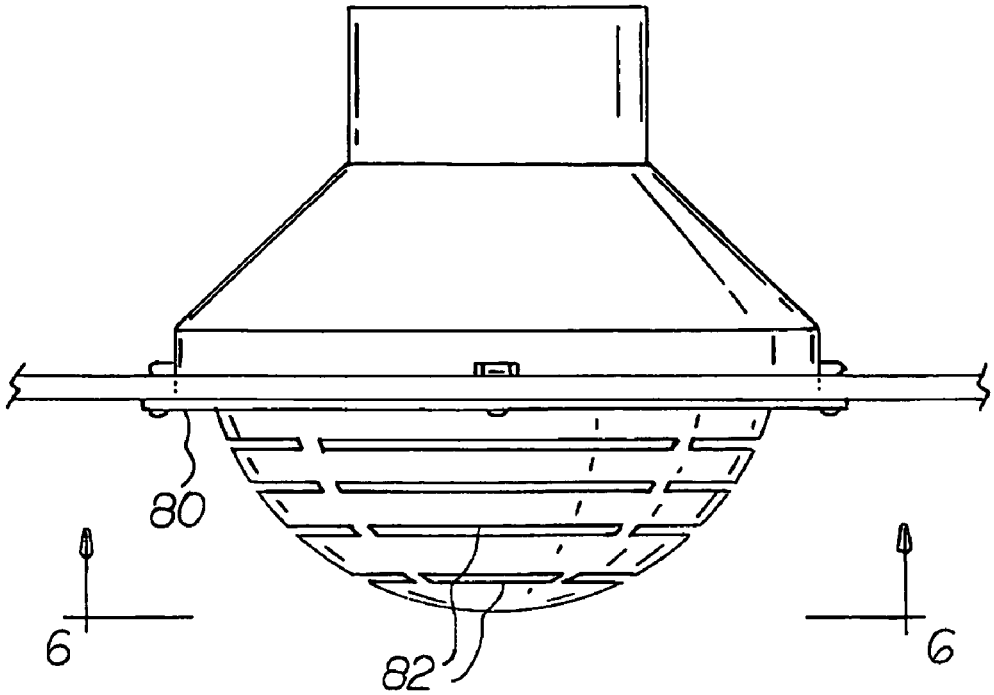
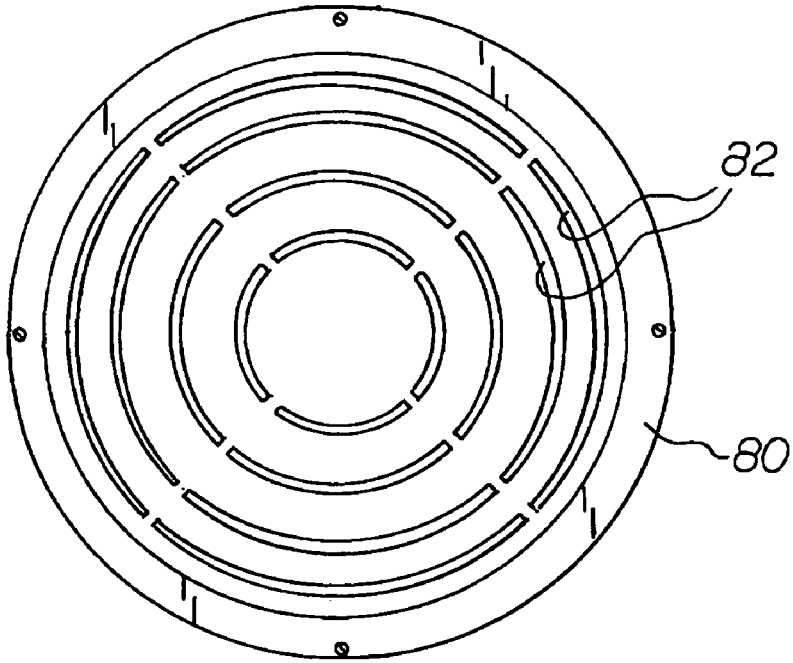
FIG 6

FIG 7
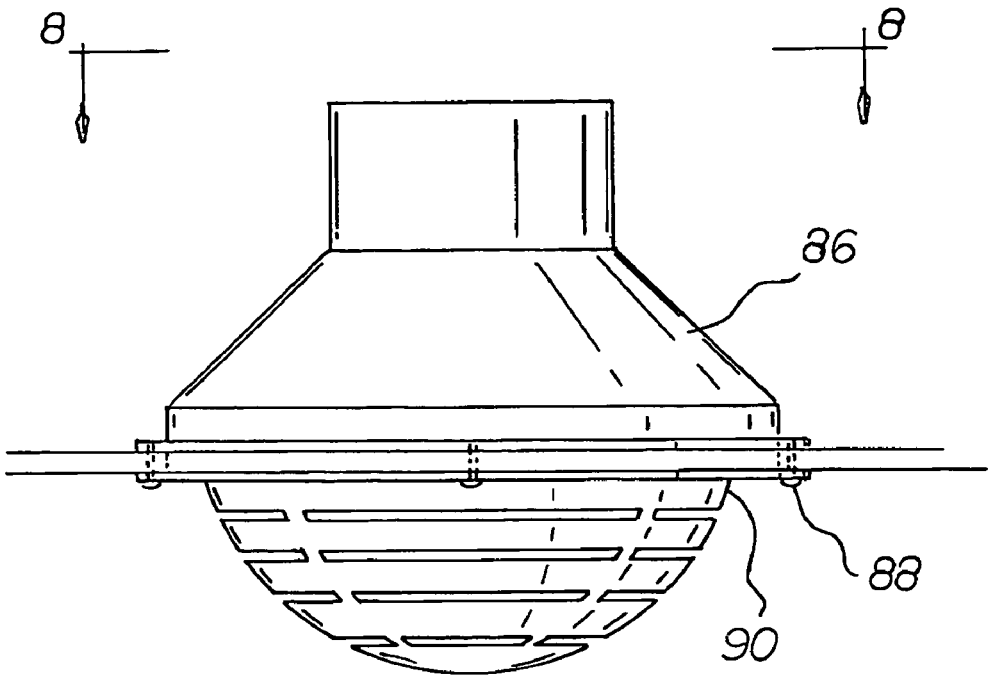
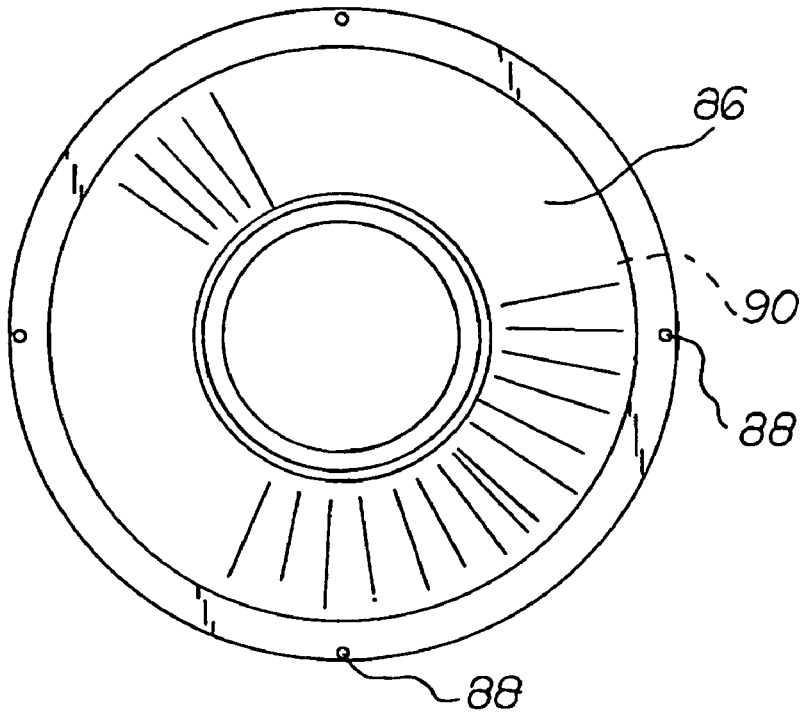
FIG 8

AIR CONDITIONER WITH A CIRCULAR AIR DIFFUSER SYSTEM

BACKGROUND OF THE INVENTION

1. Field of the Invention

The present invention relates to an air conditioner with a circular air diffuser system and more particularly pertains to facilitating the safe and convenient installation of ceiling air diffusers.

2. Description of the Prior Art

The use of air conditioners of known designs and configurations is known in the prior art. More specifically, air conditioners of known designs and configurations previously devised and utilized for the purpose of installing ceiling air diffusers through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,716,818 issued Jan. 5, 1988 to Brown relates to an air distribution device. In addition, U.S. Pat. No. 5,476,419 issued Dec. 19, 1995 to Meurer relates to a thermally actuated heating/cooling air changeover deflector structure for a ceiling diffuser. Lastly, U.S. Pat. No. 6,142,867 issued Nov. 7, 2000 to Lee relates to an indicating apparatus for a damper opening/closing apparatus of an air diffuser.

While these devices fulfill their respective, particular objectives and requirements, the aforementioned patents do not describe air conditioner with a circular air diffuser system that allows facilitating the safe and convenient installation of ceiling air diffusers.

In this respect, the air conditioner with a circular air diffuser system according to the present invention substantially departs from the conventional concepts and designs of the prior art, and in doing so provides an apparatus primarily developed for the purpose of facilitating the safe and convenient installation of ceiling air diffusers.

Therefore, it can be appreciated that there exists a continuing need for a new and improved air conditioner with a circular air diffuser system which can be used for facilitating the safe and convenient installation of ceiling air diffusers. In this regard, the present invention substantially fulfills this need.

SUMMARY OF THE INVENTION

In view of the foregoing disadvantages inherent in the known types of air conditioners of known designs and configurations now present in the prior art, the present invention provides an improved air conditioner with a circular air diffuser system. As such, the general purpose of the present invention, which will be described subsequently in greater detail, is to provide a new and improved air conditioner with a circular air diffuser system and method which has all the advantages of the prior art and none of the disadvantages.

To attain this, the present invention essentially comprises a ceiling. The ceiling has an upper surface and a lower surface. A circular aperture is provided through the ceiling. The ceiling is adapted to accommodate the passage of conditioned air into a room located below the ceiling from above. The upper and lower surfaces define a ceiling thickness between the upper and lower surfaces.

A boot is provided. The boot is fabricated of a rigid material. The material is preferably stamped sheet metal. The boot has a cylindrical lower section. The cylindrical lower section has a lower edge with a large circular cross sectional configuration. The boot has a cylindrical upper section. The cylindrical upper section has an upper edge with a small circular cross sectional configuration. The boot has an intermediate section. The intermediate section is in a frusto-conical configuration. The intermediate section joins the upper and lower sections. The upper, lower and intermediate sections each having an axial length and a common vertical axis during operation and use. The diameter of the circular aperture is slightly greater than the diameter of the lower section of the boot. The axial length of the lower section of the boot is greater than the thickness of the ceiling. In this manner the boot may be placed into the circular aperture from below. The lower edge of the boot is essentially flush with the lower surface of the ceiling. The boot also includes a circular flange. The circular flange extends radially outwardly from the lower edge of the boot. An upper surface is in facing contact with the lower surface of the ceiling. The circular flange has four threaded apertures. The apertures are equally spaced around the flange with axes parallel with the central axis of the boot.

Provided next is a layer of a thermally insulating material secured to the interior face of the boot.

A flexible hose is provided. The flexible hose has a circular cross section. The flexible hose has an output end. The output end is coupled to the upper section of the boot. The flexible hose has an input end. The input end is adapted to be coupled to an air conditioner for supplying conditioned air from an air conditioner to the boot and then to beneath the ceiling.

A support assembly is provided. The support assembly includes four short equally spaced circumferential primary slots. The slots are formed through the lower section of the boot and layer and are spaced at a common first distance from the lower edge of the boot. The support assembly includes four essentially U-shaped clips. The clips have flared free ends. The clips are fabricated of a resilient material. The material is preferably plastic. The clips are positioned from interior of the boot through the primary slots. In this manner a ceiling adjacent to the circular aperture will be securely contacted and held between the flange and the clips.

Provided next are four short equally spaced circumferential secondary slots. The slots are formed through the lower section of the boot and layer. The slots are rotationally offset from the first slots and are spaced at a common second distance from the lower edge of the boot. In this manner a ceiling of a second thickness, greater than the first distance, adjacent to the circular aperture will be securely contacted and held between the flange and the clips.

Further provided are four short equally spaced circumferential tertiary slots. The slots are formed through the lower section of the boot and layer. The slots are rotationally offset from the first slots and are spaced at a common third distance from the lower edge of the boot. In this manner a ceiling of a third thickness, greater than the second distance, adjacent to the circular aperture will be securely contacted and held between the flange and the clips.

Provided last is a grill. The grill is in an essentially flat circular configuration. The grill has an exterior diameter equal to the exterior diameter of the flange. Four threaded apertures are provided. The apertures are aligned with the apertures of the flange with four bolts. In this manner the grill is removably coupled to the boot. The grill has a plurality of arcuate slots. The slots terminate in lips. The lips have centers of curvature on a common side of the grill to direct the flow of air there through to a preselected direction.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air conditioner with a circular air diffuser system which has all of the advantages of the prior art air conditioners of known designs and configurations and none of the disadvantages.

It is another object of the present invention to provide a new and improved air conditioner with a circular air diffuser system which may be easily and efficiently manufactured and marketed.

It is further object of the present invention to provide a new and improved air conditioner with a circular air diffuser system which is of durable and reliable constructions.

An even further object of the present invention is to provide a new and improved air conditioner with a circular air diffuser system which is susceptible of a low cost of manufacture with regard to both materials and labor, and which accordingly is then susceptible of low prices of sale to the consuming public, thereby making such air conditioner with a circular air diffuser system economically available to the buying public.

Even still another object of the present invention is to provide an air conditioner with a circular air diffuser system for facilitating the safe and convenient installation of celing air-diffusers.

Lastly, it is an object of the present invention to provide a new and improved air conditioner with a circular air diffuser system. A ceiling has an upper surface, a lower surface and a circular aperture. A boot has a cylindrical lower section and a large circular cross sectional configuration and with a cylindrical upper section and a small circular cross sectional configuration. The diameter of the circular aperture is slightly greater than the diameter of the lower section of the boot. The boot also includes a circular flange extending radially outwardly from the lower edge of the boot with threaded apertures around the flange. A grill has an exterior diameter equal to the exterior diameter of the flange. Threaded apertures are aligned with the apertures of the flange with bolts to removably couple the grill to the boot. The grill has a plurality of slots for the flow of air there through.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an air conditioner with a circular air diffuser system constructed in accordance with the principles of the present invention.

FIG. 2 is a bottom view of the system taken along line 2—2 of FIG. 1.

FIG. 3 is a cross sectional view of the system taken along line 3—3 of FIG. 1.

FIG. 4 is an enlarged cross sectional view of the system taken at circle 4 of FIG. 3.

FIG. 5 is a side elevational view similar to FIG. 1 but illustrating an alternate embodiment of the invention.

FIG. 6 is a bottom view of the alternate embodiment taken along line 6—6 of FIG. 5.

FIG. 7 is a side elevational view similar to FIGS. 1 and 5 but illustrating another alternate embodiment of the invention.

FIG. 8 is a top view of the other alternate embodiment taken along line 8—8 of FIG. 7.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved air conditioner with a circular air diffuser system embodying the principles and concepts of the present invention and generally designated by the reference numeral 10 will be described.

The present invention, the air conditioner with a circular air diffuser system 10 is comprised of a plurality of components. Such components in their broadest context include a ceiling, a boot, and a grill. Such components are individually configured and correlated with respect to each other so as to attain the desired objective.

First provided is a ceiling 14. The ceiling has an upper surface 16 and a lower surface 18. A circular aperture 20 is provided through the ceiling. The ceiling is adapted to accommodate the passage of conditioned air into a room located below the ceiling from above. The upper and lower surfaces define a ceiling thickness between the upper and lower surfaces.

A boot 24 is provided. The boot is fabricated of a rigid material. The material is preferably stamped sheet metal. The boot has a cylindrical lower section 26. The cylindrical lower section has a lower edge with a large circular cross sectional configuration. The boot has a cylindrical upper section 28. The cylindrical upper section has an upper edge with a small circular cross sectional configuration. The boot has an intermediate section 30. The intermediate section is in a frusto-conical configuration. The intermediate section joins the upper and lower sections. The upper, lower and intermediate sections each having an axial length and a common vertical axis during operation and use. The diameter of the circular aperture is slightly greater than the diameter of the lower section of the boot. The axial length of the lower section of the boot is greater than the thickness of the ceiling. In this manner the boot may be placed into the circular aperture from below. The lower edge of the boot is essentially flush with the lower surface of the ceiling. The boot also includes a circular flange 32. The circular flange extends radially outwardly from the lower edge of the boot. An upper surface is in facing contact with the lower surface of the ceiling. The circular flange has four threaded apertures 34. The apertures are equally spaced around the flange with axes parallel with the central axis of the boot.

Provided next is a layer 38 of a thermally insulating material secured to the interior face of the boot.

A flexible hose 42 is provided. The flexible hose has a circular cross section. The flexible hose has an output end 44. The output end is coupled to the upper section of the boot. The flexible hose has an input end 46. The input end is adapted to be coupled to an air conditioner for supplying conditioned air from an air conditioner to the boot and then to beneath the ceiling.

A support assembly 50 is provided. The support assembly includes four short equally spaced circumferential primary slots 52. The slots are formed through the lower section of the boot and layer and are spaced at a common first distance from the lower edge of the boot. The support assembly includes four essentially U-shaped clips 54. The clips have flared free ends 56. The clips are fabricated of a resilient material. The material is preferably plastic. The clips are positioned from interior of the boot through the primary slots. In this manner a ceiling adjacent to the circular aperture will be securely contacted and held between the flange and the clips.

Provided next are four short equally spaced circumferential secondary slots 60. The slots are formed through the lower section of the boot and layer. The slots are rotationally offset from the first slots and are spaced at a common second distance from the lower edge of the boot. In this manner a ceiling of a second thickness, greater than the first distance, adjacent to the circular aperture will be securely contacted and held between the flange and the clips.

Further provided are four short equally spaced circumferential tertiary slots 64. The slots are formed through the lower section of the boot and layer. The slots are rotationally offset from the first slots and are spaced at a common third distance from the lower edge of the boot. In this manner a ceiling of a third thickness, greater than the second distance, adjacent to the circular aperture will be securely contacted and held between the flange and the clips.

Provided last is a grill 68. The grill is in an essentially flat circular configuration. The grill has an exterior diameter equal to the exterior diameter of the flange. Four threaded apertures 70 are provided. The apertures are aligned with the apertures of the flange with four bolts 72. In this manner the grill is removably coupled to the boot. The grill has a plurality of arcuate slots 74. The slots terminate in lips 76. The lips have centers of curvature on a common side of the grill to direct the flow of air there through to a preselected direction.

In an alternate embodiment of the present invention, the grill 80 is in a dome shaped configuration. A series of concentric slots are formed in thew grill for difussing of the air. Note FIGS. 5 and 6.

In another alternate embodiment of the present invention the lower section of the boot 86 is imperforate. The bolts 88 are of an extended length to couple the flange of the boot and the grill 90 with the ceiling there between. Note FIGS. 7 and 8.

Note is taken that the embodiment of FIGS. 7 and 8 positions the flange of the boot above ceiling. As such, with the diameter of the flange being greater than the diameter of the ceiling aperture, the boot must be installed from above the ceiling, In contrast to this, the embodiment of FIGS. 1–4 and the embodiment of FIGS. 5 and 6, position the flange of the boot below the ceiling, and, as a result, the boot may be installed from below the ceiling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioner with a circular air diffuser system for facilitating the safe and convenient installation of ceiling air diffusers comprising, in combination:

a ceiling with an upper surface and a lower surface and a circular aperture there through adapted to accommodate the passage of conditioned air into a room located below the ceiling from above, the upper and lower surfaces defining a ceiling thickness there between;

a boot fabricated of a rigid material having a cylindrical lower section with a lower edge and a large circular cross sectional configuration and with a cylindrical upper section with an upper edge and a small circular cross sectional configuration and with an intermediate section in a frusto-conical configuration joining the upper and lower sections, the upper and lower and intermediate sections each having an axial length and a common vertical axis during operation and use, the diameter of the circular aperture being slightly greater than the diameter of the lower section of the boot with the axial length of the lower section of the boot being greater than the thickness of the ceiling whereby the boot may be placed into the circular aperture from below with the lower edge of the boot being essentially flush with the lower surface of the ceiling, the boot also including a circular flange extending radially outwardly from the lower edge of the boot with an upper surface in facing contact with the lower surface of the ceiling, the circular flange having four threaded apertures equally spaced around the flange with axes parallel with the central axis of the boot;

a layer of a thermally insulating material secured to the interior face of the boot;

a flexible hose with a circular cross section having an output end coupled to the upper section of the boot an input end adapted to be coupled to an air conditioner for supplying conditioned air from an air conditioner to the boot and then to beneath the ceiling;

a support assembly including four short equally spaced circumferential primary slots formed through the lower section of the boot and layer and spaced at a common first distance from the lower edge of the boot and four essentially U-shaped clips with flared free ends and fabricated of a resilient material positioned from interior of the boot through the primary slots whereby a ceiling adjacent to the circular aperture will be securely contacted and held between the flange and the clips;

four short equally spaced circumferential secondary slots formed through the lower section of the boot and layer, rotationally offset from the first slots, and spaced at a common second distance, different from the first distance, from the lower edge of the boot whereby a ceiling of a second thickness, greater than the first distance, adjacent to the circular aperture will be securely contacted and held between the flange and the clips;

four short equally spaced circumferential tertiary slots formed through the lower section of the boot and layer, rotationally offset from the first slots, and spaced at a common third distance, different from the first and second distances, from the lower edge of the boot whereby a ceiling of a third thickness, greater than the second distance, adjacent to the circular aperture will be securely contacted and held between the flange and the clips; and a grill in an essentially flat circular configuration and an exterior diameter equal to the exterior diameter of the flange with four threaded apertures aligned with the apertures of the flange with four bolts to removably couple the grill to the boot, the grill having a plurality of arcuate slots terminating in lips having centers of curvature on a common side of the grill to direct the flow of air there through to a preselected direction.

* * * * *